US006043783A

United States Patent [19]

Endo et al.

[11] Patent Number: 6,043,783

[45] Date of Patent: Mar. 28, 2000

[54] WINDOWPANE ANTENNA APPARATUS FOR USE IN VEHICLES

[75] Inventors: Hiroshi Endo, Tokyo; Masatoshi Saito, Machida; Hiroyuki Tachihara, Inzai, all of Japan; David Briggs, Worcestershire, United Kingdom

[73] Assignee: Harada Industry Co., Ltd., Tokyo, Japan

[21] Appl. No.: 09/016,625

[22] Filed: Jan. 30, 1998

[30] Foreign Application Priority Data

Jan. 30, 1997 [JP] Japan ..... 9-016048

[51] Int. Cl.[7] ..... H01Q 1/32

[52] U.S. Cl. ..... 343/713; 343/876

[58] Field of Search ..... 343/704, 713, 343/876

[56] References Cited

U.S. PATENT DOCUMENTS

| | | | |
|---|---|---|---|
| 4,439,771 | 3/1984 | Klume et al. | 343/704 |
| 4,791,426 | 12/1988 | Lindenmeier et al. | 343/713 |
| 4,823,140 | 4/1989 | Shibata et al. | 343/713 |
| 4,845,505 | 7/1989 | Ohe et al. | 343/713 |
| 4,864,316 | 9/1989 | Kaoru et al. | 343/704 |
| 5,049,892 | 9/1991 | Lindenmeier et al. | 343/713 |
| 5,056,153 | 10/1991 | Taniguchi et al. | 455/89 |
| 5,264,858 | 11/1993 | Shiina | 343/713 |
| 5,581,264 | 12/1996 | Tabata et al. | 343/713 |

FOREIGN PATENT DOCUMENTS

4321805A1 1/1994 Germany .

OTHER PUBLICATIONS

EPO European Search Report, EP/98/30/0552, issued May 22, 1998 (Exhibit B) Asahi Glass Co. Ltd., Patent Abstracts of Japan (Exhibit E).

*Primary Examiner*—Don Wong
*Assistant Examiner*—Tan Ho
*Attorney, Agent, or Firm*—John P. White; Cooper & Dunham LLP

[57] ABSTRACT

A windowpane antenna apparatus for use in a vehicle according to the present invention, includes a plurality of conductive strips arranged in a windowpane of the vehicle so as to have a predetermined pattern, function designation switches turned on to transmit/receive predetermined waves, an arithmetic unit for performing an arithmetic operation of obtaining a combination of the plurality of conductive strips in order to form a desired antenna having antenna characteristics matching a function designated by the function designation switches, and a selective connecting switch for selecting one or some of the conductive strips based on the combination of the conductive strips obtained by the arithmetic unit and connecting the selected some of the conductive strips to form the desired antenna.

7 Claims, 3 Drawing Sheets

WINDOWPANE ANTENNA APPARATUS FOR USE IN VEHICLES

BACKGROUND OF THE INVENTION

The present invention relates to a windowpane antenna apparatus attached to a windowpane of a vehicle such as an automobile.

Conventionally there is an automobile windowpane antenna apparatus as the most typical one for use in vehicles. In the automobile windowpane antenna apparatus, a thin, narrow conductive strip is provided on an automobile windowpane (usually a rear window glass) and employed as an antenna.

Recently a defogger serving as a heater for clearing condensed moisture, has been provided on almost all over a rear window of an automobile. Therefore, a space for providing the above conductive strip as an antenna is limited to a small one interposed between the defogger and the frame of the window.

The conventional automobile windowpane antenna apparatus has the following problem. The space in the windowpane on which an antenna can be mounted, is very small.

However, there has recently been a demand for receiving TV broadcasting waves and GPS waves and transmitting/receiving portable telephone waves as well as FM/AM broadcasting waves, and there has been a strong request to satisfy the demand only by a windowpane antenna apparatus.

However, it is physically impossible to provide different antennas separately in the above small space of a windowpane. If they were done, an interference would occur among the antennas thereby to degrade the characteristics thereof.

BRIEF SUMMARY OF THE INVENTION

The present invention has been developed in order to resolve the problem caused when a large variety of antennas are employed at the same time, and its object is to provide a vehicle windowpane antenna apparatus wherein a large variety of antennas can be provided in a limited small space on a vehicle windowpane without degrading the characteristics of the antennas.

In order to attain the above object, according to one aspect of the present invention, there is provided a windowpane antenna apparatus for use in a vehicle, comprising:

a plurality of conductive strips arranged in a windowpane of the vehicle so as to have a predetermined pattern; and means for selecting conductive strips from the plurality of conductive strips and connecting the selected conductive strips to form an antenna having a desired function.

According to another aspect of the present invention, there is provided a windowpane antenna apparatus for use in a vehicle, comprising:

a plurality of conductive strips arranged in a windowpane of the vehicle so as to have a predetermined pattern;

function designation switches turned on to cause a predetermined transmission/reception set to transmit/receive waves;

an arithmetic unit for performing an arithmetic operation to obtain an optimum combination of the plurality of conductive strips in order to form a desired antenna having antenna characteristics matching a function designated by the function designation switches; and a selective connecting switch for selecting one or some of the conductive strips based on the optimum combination obtained by the arithmetic unit and connecting the selected one or some of the conductive strips to form a desired antenna.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION (First Embodiment)

Figure 1:
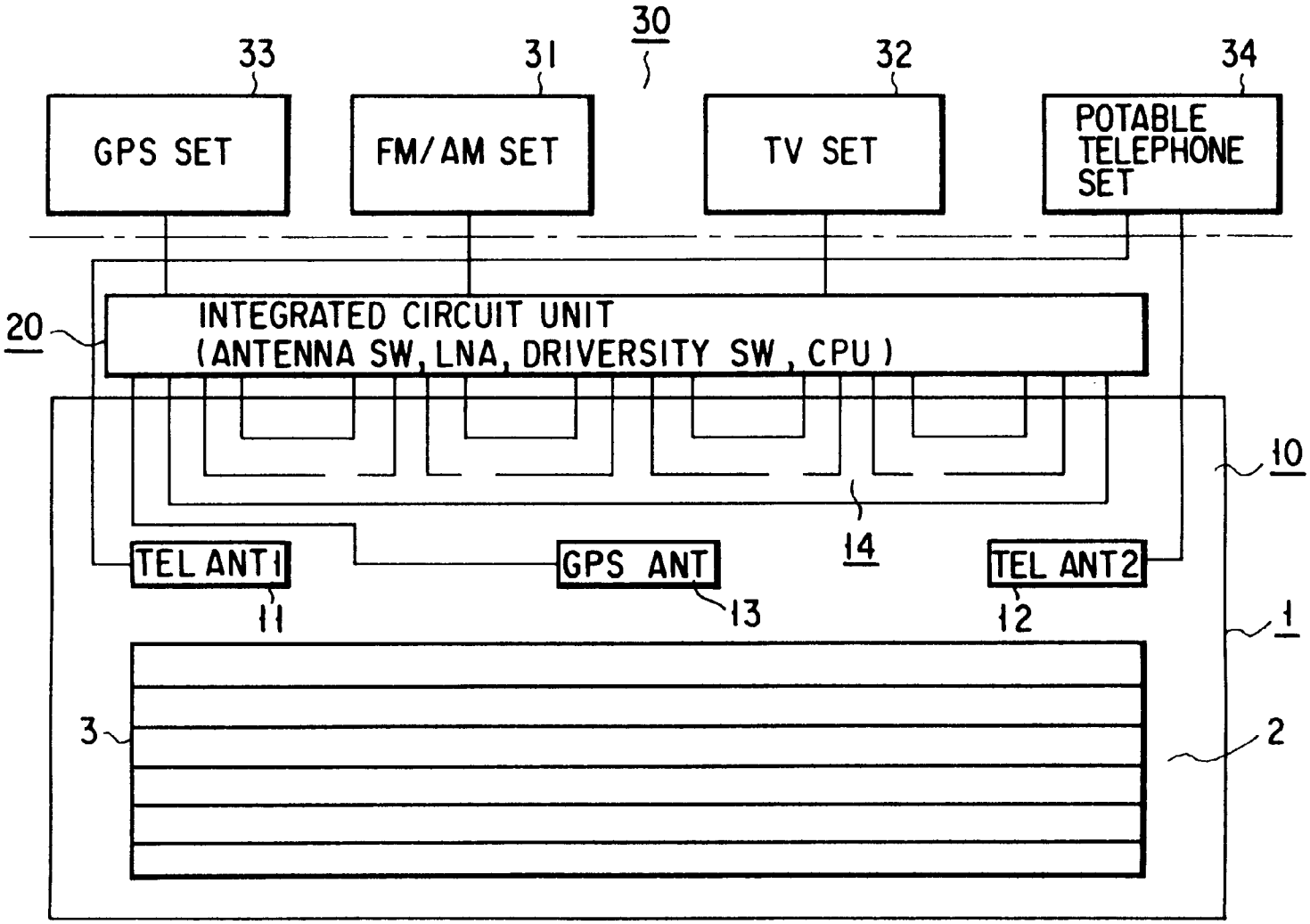
FIG. 1 is a block diagram illustrating the constitution of a vehicle windowpane antenna apparatus according to a first embodiment of the present invention.

FIG. 1 is a block diagram showing the constitution of a vehicle windowpane antenna apparatus according to a first embodiment of the present invention.

As shown in FIG. 1, a defogger 3, which serves as a heater for clearing condensed moisture, is provided from the central part toward the lower part in a windowpane 2 of a rear window 1 of a vehicle (e.g., automobile). A glass antenna section 10 is provided in a space above the windowpane 2 between the upper portion of the defogger 3 and the window frame. The glass antenna section 10 includes a first TEL antenna element 11, a second TEL antenna element 12, a GPS antenna element 13, and a multiple band antenna element 14 which are formed in a predetermined pattern.

The defogger 3 and antenna elements 11 to 14 are each formed of a very thin, narrow conductive strip. The conductive strip, particularly the conductive strip of the multiple band antenna element 14 includes a strip which has a desired characteristic alone as one antenna, a strip which does not have it alone as one antenna but serves as part of an antenna in combination with another conductive strip.

The first and second TEL antenna elements 11 and 12 are formed opposite to each other on the right and left sides of the windowpane 2 for diversity reception, and connected directly to a portable telephone set 34. The GPS antenna element 13 and multiple band antenna element 14 are connected to an FM/AM set 31, a TV set 32 and a GPS set 33 of a transmission/reception set 30 via an integrated circuit unit 20.

Figure 2:
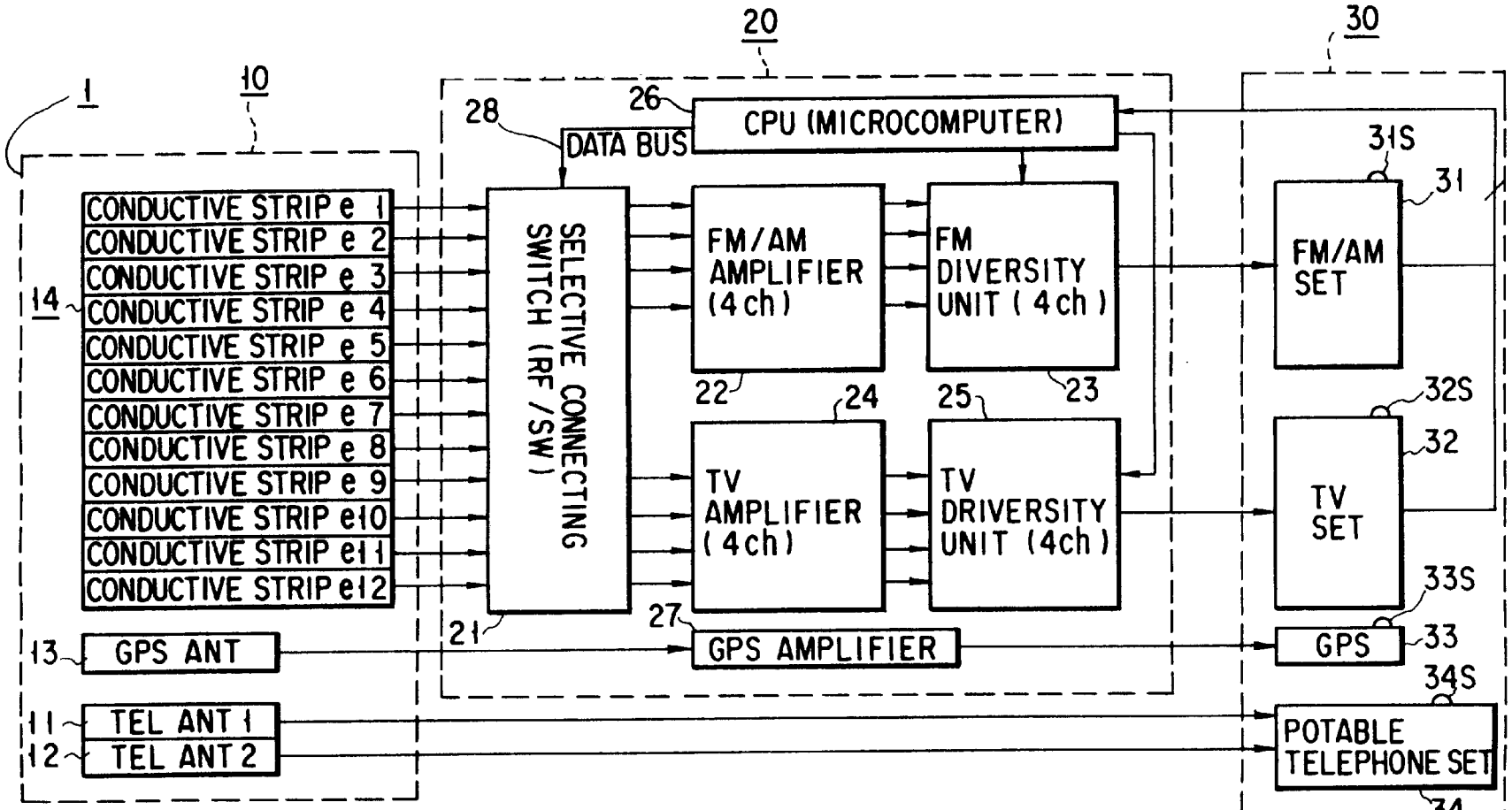
FIG. 2 is a block diagram illustrating the constitution of an electrical system of the apparatus of FIG. 1.

FIG. 2 is a block diagram illustrating the constitution of an electrical system of the apparatus shown in FIG. 1. Referring to FIG. 2, the multiple band antenna element 14 of the glass antenna section 10 has twelve conductive strips e1 to e12. These conductive strips e1 to e12 and GPS antenna element 13 are each connected to the integrated circuit unit 20.

The unit 20 includes a selective connecting switch 21 constituted of an electronic switch, an FM/AM amplifier 22, an FM diversity unit 23, a TV amplifier 24, a TV diversity unit 25, a CPU (microcomputer) 26 serving as an arithmetic unit, and a GPS amplifier 27.

The CPU 26 operates an arithmetic operation for obtaining a combination of the conductive strips e1 to e12 to optimize the electrical length of a synthesized antenna in accordance with a designated function (described later), determines a combination of the conductive strips to allow diversity reception when a designated function is reception of at least broadcasting waves such as FM/AM broadcasting waves and TV broadcasting waves, and the like.

In the first embodiment, the transmission/reception set 30 includes four sets of FM/AM set 31, TV set 32, GPS set 33, and portable telephone set 34, these sets have their respective function designation switches 31*s*, 32*s*, 33*s* and 34*s* which also serve as a power switch to be turned on at the time of reception and transmission.

The FM/AM amplifier 22 and FM diversity unit 23 are of a four-channel type, as are the TV amplifier 24 and TV diversity unit 25. The FM/AM amplifier 22, TV amplifier 24, and GPS amplifier 27 are each constituted of an LNA (low noise amplifier) to prevent reception sensitivity from deteriorating.

An operation of the vehicle windowpane antenna apparatus so constituted, will now be described.

A call signal is received by the first and second TEL antenna elements 11 and 12 and then input to the portable telephone set 34. The portable telephone set 34 performs diversity reception to allow a user to call with good reception characteristic free of phasing. To call by a portable telephone, a signal is transmitted through the first TEL antenna element 11 or the second TEL antenna element 12.

When the function designation switch 33*s* of the GPS set 33 is turned on, a signal of GPS waves received by the GPS antenna element 13 is input to the GPS set 33 through the GPS amplifier 27. Thus, various types of information can be obtained through the GPS waves.

If the function designation switch 31*s* is turned on to designate a function when FM/AM broadcasting waves are received, the function is input to the CPU 26. In the CPU 26, the optimum combination of the conductive strips e1 to e12 is calculated and determined in consideration of the electrical length of an antenna in order to form a desired antenna having antenna characteristics matching the designated function. A result of this determination is supplied to the selective connecting switch 21 through a data bus 28. The switch 21 is thus selects one or some of the conductive strips e1 to e12 based on the result of the determination and connect them to form the desired antenna having the electrical length of the antenna which is the most suitable for reception frequency. The FM or AM broadcasting waves received by the antenna so formed, are supplied to the FM/AM set 31 via the selective connecting switch 21, FM/AM amplifier 22 and FM diversity unit 23. Consequently, a user can listen to an FM/AM radio broadcast based on good reception characteristics due to diversity reception.

If the function designation switch 32*s* is turned on to designate a function when TV broadcasting waves are received, as in the case of reception of the FM/AM waves, the function is input to the CPU 26. In the CPU 26, the optimum combination of the conductive strips e1 to e12 is determined in order to form a desired antenna having antenna characteristics matching the designated function. A result of this determination is supplied to the selective connecting switch 21. The switch 21 is thus selects one or some of the conductive strips e1 to e12 based on the result of the determination and connect them to form the desired antenna having the electrical length of the antenna which is the most suitable for reception frequency. The TV broadcasting waves received by the antenna so formed, are supplied to the TV set 32 via the selective connecting switch 21, TV amplifier 24 and TV diversity unit 25. Consequently, a user can watch TV based on good reception characteristics due to diversity reception.

The CPU 26 always monitors the reception conditions of FM/AM and TV broadcasting waves. If multipath noise, phasing or the like occurs, the CPU 26 determines whether the diversity reception is changed by the FM diversity unit 23 or TV diversity unit 25, whether the conductive strips e1 to e12 are selected again by the selective connecting switch 21 (change in beam), or the like, and performs a control operation based on a result of the determination. Thus, automatic control is executed so as to maintain the optimum receiving condition at times.

(Second Embodiment)

Figure 3:
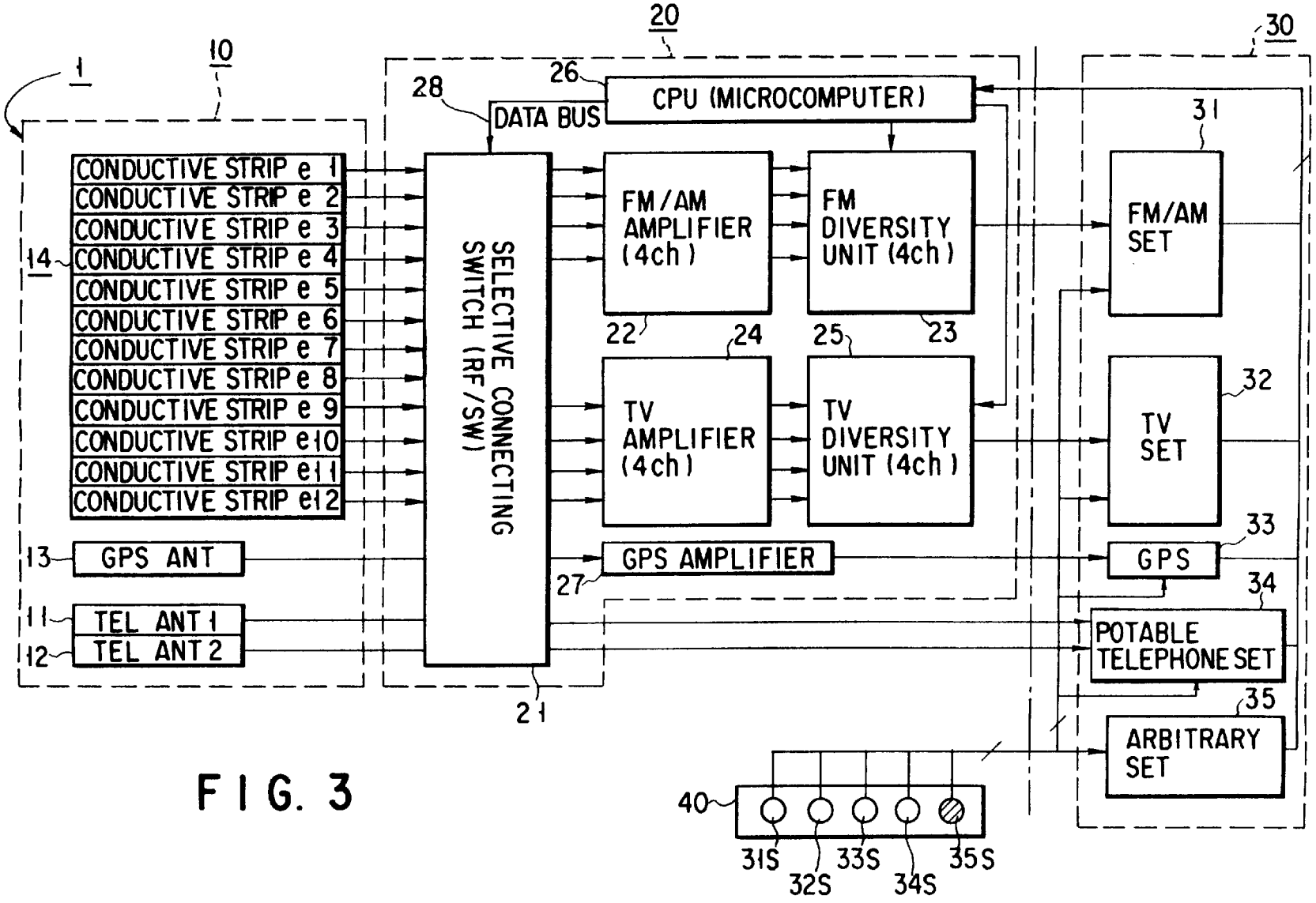
FIG. 3 is a block diagram illustrating the constitution of an electrical system of a vehicle windowpane antenna apparatus according to a second embodiment of the present invention.

FIG. 3 is a block diagram illustrating the constitution of an electrical system of a vehicle windowpane antenna apparatus according. to a second embodiment of the present invention. The second embodiment differs from the first embodiment in the following two points.

1) The above-described function designation switches 31*s* to 34*s* and an arbitrary function designation switch 35s are arranged together on a dedicated switch board 40.

A function designating operation can be carried out easily and exactly, thereby allowing transmission and reception other than the reception of FM/AM and TV broadcasting waves and GPS waves and the transmission/reception of portable telephone waves.

2) By operating the foregoing function designation switches 31*s* to 34*s* and arbitrary function designation switch 35*s*, the FM/AM set 31, TV set 32, GPS set 33, portable telephone set 34, and arbitrary transmission/reception set 35 are operated, the CPU 26 is operated in response to the operation, and the selective connecting switch 21 is controlled, thereby selectively connecting all the antenna elements 11 to 14.

Consequently, some of the conductive strips e1 to e12 of, e.g., the multiple band antenna element 14 can properly be added as auxiliary antenna elements for transmitting/receiving the portable telephone waves and receiving the GPS waves.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

We claim:

1. A windowpane antenna apparatus for use in a vehicle, comprising:

a plurality of conductive strips arranged in a windowpane of the vehicle so as to have a predetermined pattern;

function designation switches turned on to cause a predetermined transmission/reception set to transmit/receive waves;

an arithmetic unit for performing an arithmetic operation to obtain an optimum combination of the plurality of conductive strips in order to form a desired antenna having antenna characteristics matching a function designated by the function designation switches; and a selective connecting switch for selecting one or some of the conductive strips based on the optimum combination obtained by the arithmetic unit and connecting the selected one or some of the conductive strips to form the desired antenna.

2. The antenna apparatus according to claim 1, wherein the plurality of conductive strips include a conductive strip which has a desired characteristic alone as one antenna and a conductive strip which does not have a desired characteristic alone as one antenna but serves as part of an antenna in combination with another conductive strip.

3. The antenna apparatus according to claim 1, wherein the function designation switches are capable of designating at least reception of FM/AM broadcasting waves, TV broadcasting waves, and GPS waves, and a transmission/reception of portable telephone waves.

4. The antenna apparatus according to claim 1, wherein the function designation switches each serve as a power switch, too.

5. The antenna apparatus according to claim 1, wherein the function designation switches are arranged together in a dedicated switch board.

6. The antenna apparatus according to claim 1, wherein the arithmetic unit has a function of performing an arithmetic operation to obtain a combination of the plurality of conductive strips in order to optimize an electrical length of a synthesized antenna.

7. The antenna apparatus according to claim 1, wherein the arithmetic unit has a function of selecting a combination of the plurality of conductive strips so as to allow diversity reception when at least reception of broadcasting waves is designated.

* * * * *